US005081393A

United States Patent [19]

Kinami

[11] Patent Number: 5,081,393

[45] Date of Patent: Jan. 14, 1992

[54] ELECTRON GUN HAVING ELECTRODES EFFECTIVE FOR IMPROVING CONVERGENCE IN A COLOR CATHODE-RAY TUBE

[75] Inventor: Takashi Kinami, Mobara, Japan

[73] Assignees: Hitachi, Ltd., Tokyo; Hitachi Device Engineering Co., Ltd., Chiba, both of Japan

[21] Appl. No.: 491,832

[22] Filed: Mar. 12, 1990

[30] Foreign Application Priority Data

Mar. 18, 1989 [JP] Japan ..... 1-66897

[51] Int. Cl.[5] ..... H01J 29/50

[52] U.S. Cl. ..... 313/412; 313/414; 420/43; 420/584.1

[58] Field of Search ..... 313/311, 412, 414, 417; 420/43, 452, 584.1, 580

[56] References Cited

U.S. PATENT DOCUMENTS 3,159,480 12/1964 Copson ..... 420/580.1 X
4,492,894 1/1985 Reule et al. ..... 313/414
4,631,442 12/1986 Reule et al. ..... 313/414
4,827,178 5/1989 Higashinakagawa et al. ... 420/584.1

FOREIGN PATENT DOCUMENTS 3334242 9/1983 Fed. Rep. of Germany .
60-95836 5/1986 Japan .
61-290635 12/1986 Japan .

*Primary Examiner*—Donald J. Yusko
*Assistant Examiner*—Ashok Patel
*Attorney, Agent, or Firm*—Antonelli, Terry, Stout & Kraus

[57] ABSTRACT

An electron gun for a color cathode-ray tube has cathodes for producing electron beams and a control electrode unit, a focusing electrode unit and an accelerating unit successively arranged in a direction of the axis of the electron gun. One or more of the above-mentioned electrode units is made of an alloy containing 38–50 Wt % of Ni, 16–20 wt % of Cr and the balance of Fe. This alloy may have a thermal expansion coefficient not higher than about $15\times10^{-6}$/°C. and or a relative permeability not higher than about 1.5.

10 Claims, 7 Drawing Sheets

ELECTRON GUN HAVING ELECTRODES EFFECTIVE FOR IMPROVING CONVERGENCE IN A COLOR CATHODE-RAY TUBE

BACKGROUND OF THE INVENTION

The present invention relates to a color cathode-ray tube (hereinafter simply referred to as a color CRT) for use in, for example, a display unit of work station or data processor, and more particularly to an electron gun of this type of color CRT. The color CRT of this invention may also be used for other display units than the above.

As diagrammatically exemplified in FIG. 1, the color CRT includes a panel portion P provided with an image screen formed of a phosphor layer 100, a neck portion N for accommodating an electron gun 200, and a funnel portion F for connecting the panel portion P and neck portion N. Mounted on the funnel portion F is a deflection unit DY operable to scan electron beams B, emitted from the electron gun 200, on the phosphor layer 100 coated on the inner surface of the panel portion P.

The electron gun 200 accommodated in the neck portion N has various electrode units including a cathode electrode unit, a control electrode unit, a focusing electrode unit of a non-magnetic material and an accelerating electrode unit of a non-magnetic material which are arranged successively in a direction of the axis of the electron gun. The cathode electrode unit includes a plurality of cathodes and electron beams produced from the cathodes are each modulated by a signal applied to the control electrode unit, and formed into a requisite crossectional shape and supplied with requisite energy through the focusing electrode unit and accelerating unit so as to be caused to impinge on the phosphor layer 100. Midway between the electron gun and the phosphor layer, each electron beam is deflected horizontally and vertically by a magnetic field H generated from the deflection unit DY mounted on the funnel portion F so that a two-dimentional image to be displayed can be formed on the image screen. Denoted by M is a convergence adjusting magnet assembly.

The electron gun 200 is supplied with power in operation and its temperature rises considerably. Specifically, heaters of the cathode electrode unit generate heat, beginning with the start of operation of the color CRT and the temperature of the electron gun is raised by the heat. With the electron gun's temperature raised, electrodes forming the electron gun undergo a deformation due to the heat and relative position change and as a result, trajectories for the electron beams change.

More particularly, electrode deformation and a change in the relative positional relation between adjacent electrodes take place, and an electric field (electron lens) formed by the electrodes is distorted to prevent the electron beam from travelling on a requisite trajectory. This brings about degradation in focus characteristic and convergence characteristic of the color CRT.

For these reasons, the material of the electrodes is required to have a low thermal expansion coefficient in an environment for operation of the color CRT.

Further, in order for the electrodes not to affect the electron beam trajectory which is properly determined by means of the deflection unit (deflection yoke) and static convergence adjusting magnet, the electrode material is required to be non-magnetic in the operational environment of the color CRT.

In the past, the electrodes are in general made of stainless steel having a thermal expansion coefficient $\alpha$ of about $18\times10^{-6}/°C.$, and the aforementioned degradation in focus characteristic and convergence characteristic is not always suppressed sufficiently.

To cope with this problem, JP-A-60-95836 (laid-open on May 29, 1985), for example, discloses non-magnetic and low thermal expansion coefficient materials suitable for formation of the electron gun, the materials being alloys such as nichrome alloy (an alloy containing about 80 wt % of Ni and about 20 wt % of Cr or an alloy containing about 65 wt % of Ni, about 30 wt % of Cr and 1 or less wt % of Fe) and Inconel (an alloy containing about 72 wt % of Ni, about 18 wt % of Cr and 10 or less wt % of Fe).

Each of the above materials has a low thermal expansion coefficient, but disadvantageously, it is expensive by containing a great amount of Ni and is poor in machinability due to 20 wt % of Cr or more contained therein, leading to an increase in cost of production of the electron gun and color CRT.

JP-A-61-290635 (laid-open on Dec. 20, 1986) shows an electron gun for a color CRT in which a preceding stage electrode is made of a material having a thermal expansion coefficient smaller than that of a material of a succeeding stage electrode.

SUMMARY OF THE INVENTION

An object of the present invention is to provide an electron gun including at least one electrode made of an alloy containing Ni and having good convergence and focus characteristics and a color CRT using the electron gun.

Another object of the invention is to provide an inexpensive electron gun including at least one electrode made of an alloy containing Ni and having good convergence and focus characteristics and a color CRT using the electron gun.

Still another object of the invention is to provide an electron gun for use in a color CRT which uses a relatively inexpensive material having a lower thermal expansion coefficient than the aforementioned stainless steel in the operational environment of the color CRT to minimize displacement and distortion caused by deformation due to heat, thereby improving the focus and convergence characteristics of the color CRT.

According to one aspect of the present invention, an electron gun has cathodes each for producing an electron beam and a plurality of electrodes for forming electron lenses with individual voltages applied thereto; each of the electron lenses is formed by at least two electrodes successively arranged in a direction of the axis of the electron gun in which a relatively lower first voltage and a relatively higher second voltage are respectively applied to first and second ones of the at least two electrodes in operation; the first electrode to which the relatively lower first voltage is applied for formation of an electron lense is made of an alloy containing 38–50 wt % (preferably 38–42 wt. %) of Ni, about 16–20 wt % (preferably 16–18 wt %) of Cr and the balance of Fe.

According to another aspect of the present invention, an electron gun has cathodes each for producing an electron beam and a plurality of electrodes for forming electron lenses with individual voltages applied thereto, each of the electron lenses is formed by at least two electrodes successively arranged in a direction of the axis of the electron gun in which a relatively lower first voltage and a relatively higher second voltage are respectively applied to first and second ones of the at least two electrodes in operation; at least one of the electrodes is made of an alloy containing 38–50 wt % (preferably 38–42 wt %) of Ni, 16–20 wt % (preferably 16–18 wt %) of Cr and the balance of Fe such that trajectories for the electron beams deviated by distortion of at least one electron lens due to deformation of at least one of the electrodes caused by heat generated by the cathodes in operation are corrected owing to differences in the thermal expansion coefficient between the electrodes, the alloy having a thermal expansion coefficient not higher than about $15\times10^{-6}/°C$.

According to another aspect of the present invention, an electron gun has cathodes, each for producing an electron beam and a plurality of electrodes for forming electron lenses with individual voltages applied thereto; each of the electron lenses is formed by at least two electrodes successively arranged in a direction of the axis of the electron gun in which a relatively lower first voltage and a relatively higher second voltage are respectively applied to first and second ones of the at least two electrodes in operation, the first electrode to which the relatively lower first voltage is applied for formation of an electron lense is made of a Ni-Cr-Fe alloy containing 38–50 wt % (preferably 38–42 wt %) of Ni and having a thermal expansion coefficient not higher than about $15\times10^{-6}/°C$. and a relative permeability not higher than about 1.5.

DESCRIPTION OF THE PREFERRED EMBODIMENTS

Figure 1:
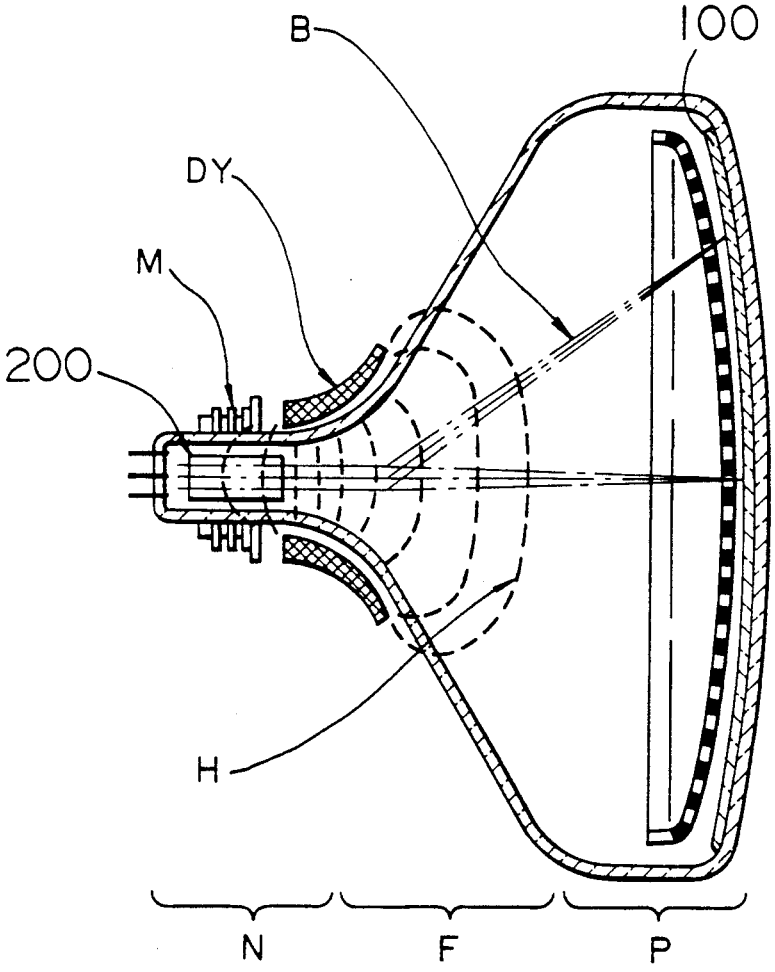
FIG. 1 is a sectional view schematically illustrating a color CRT.
Figure 2:
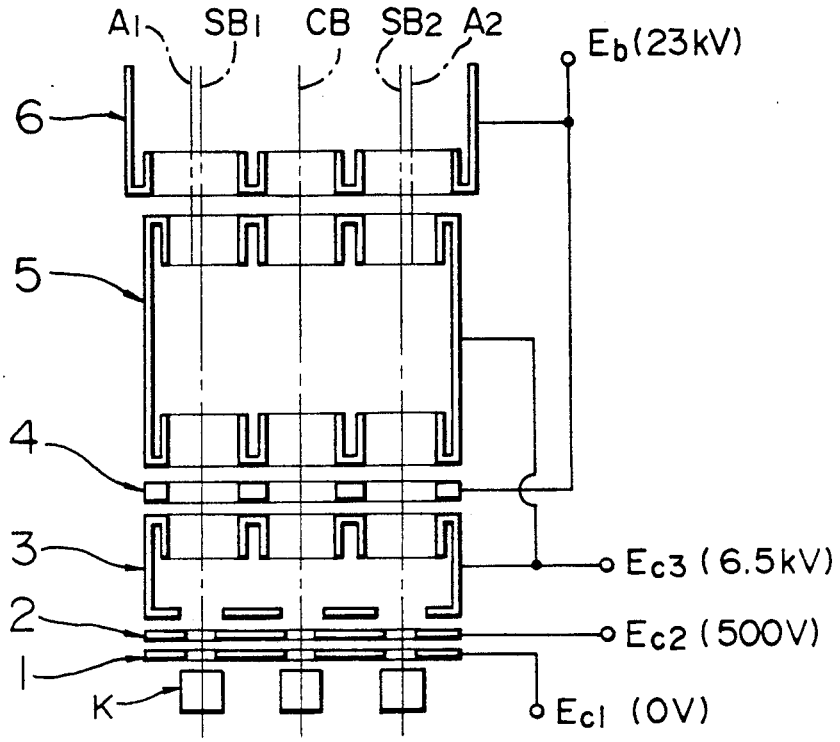
FIG. 2 is a sectional view schematically illustrating an example of an electron gun of the color CRT.

FIG. 2 schematically illustrates an electron gun of a color CRT. The electron gun exemplified herein is of an in-line type three-electron gun having a cathode electrode unit K, a G1 electrode unit 1, a G2 electrode unit 2, a G3 electrode unit 3, a G4 electrode unit 4, a G5 electrode unit 5 and an anode electrode unit 6.

Denoted by CB is a center beam; by SB1 and SB2 are beams on both sides of the center beam, and A1 and A2 are center lines of openings for beams SB1 and SB2 formed in the anode electrode unit 6, the center lines being offset outwards with respect to beam openings formed in the electrode units 1 to 5. The offset is effective to position the beams SB1 and SB2 close to the beam CB on the phosphor screen, thus facilitating static convergence adjustment. The above electrode units are arranged successively in a direction of the axis of the electron gun.

With the above construction, in operation of the color CRT which may be a 14-inch color CRT, an accelerating voltage of about 23 kV is applied to the electrode units 6 and 4, a focusing voltage of about 6.5 kV is applied to the electrode units 5 and 3, a voltage of about 500 V is applied to the electrode unit 2 and a voltage of about 0 (zero) V is applied to the electrode unit 1.

It has been proven that when all of the electrode units 1 to 6 of the electron gun are made of an alloy material containing about 42 wt % of Ni, about 19 wt % of Cr and the balance of Fe to make each electrode unit have a low thermal expansion coefficient and a low permeability, the time varying amount of deviation of static convergence measured on the phosphor screen can be improved, that is, decreased by 20% or more of that obtained with the conventional electrodes all made of stainless steel.

It is to be noted that the use of the alloy material of the above composition for all the electrode units is not limitative but the alloy material may be applied to some of the electrode units to attain great effects.

Figure 3A:
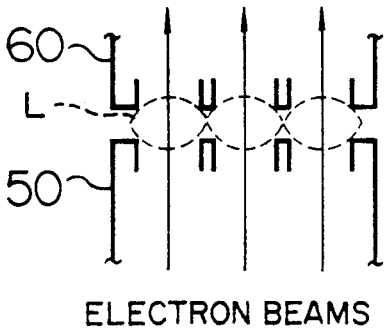
FIGS. 3A and 3B are diagrams for explaining distortion of electron lenses due to electrode expansion and undesired deflection of an electron beam.
Figure 3B:
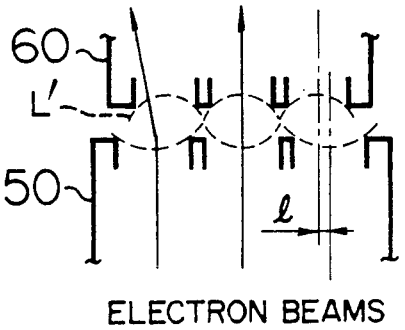

Some of the electrode units constituting the electron gun are illustrated, in sectional form, in FIGS. 3A and 3B. Electron lenses are formed initially as shown in FIG. 3A by an electrode unit 60 applied with a relatively higher voltage and an electrode unit 50 applied with a relatively lower voltage but are distorted with time owing to thermal expansion of the electrode units, as shown in FIG. 3B. The electrode units 50 and 60 are made of stainless steel.

More particularly, immediately after the start of operation of the electron gun, the electrode units are not expanded thermally as shown in FIG. 3A. Consequently, the electron lenses L are normal with the result that electron beams are subjected to focusing or accelerating by means of the electrode units so as to be directed in predetermined directions. As the time elapses, the amount of heat generated by the cathode electrode unit is increased and accumulated to raise the temperature of the electron gun, thereby causing the electrode units to expand thermally. Naturally, the temperature becomes higher close to the cathode electrode unit and consequently the electrode unit 50 is more expanded than the electrode unit 60. As a result, the electron lenses L initially formed by the electrode units 50 and 60 (FIG. 3A) are distorted to electron lenses L' (FIG. 3B) and there results a displacement of optical axis as indicated by l. It follows therefore that beams on both sides of a center beam (called side beams) are deflected undesirably outwardly as shown in FIG. 3B. When voltage applied to the electrode unit 50 is higher than that applied to the electrode unit 60, the deflection of side beams due to distortion of the electron lenses as shown in FIG. 3B is inverted and directed inwards (in a direction in which the side beams approach the center beam).

Figure 4:
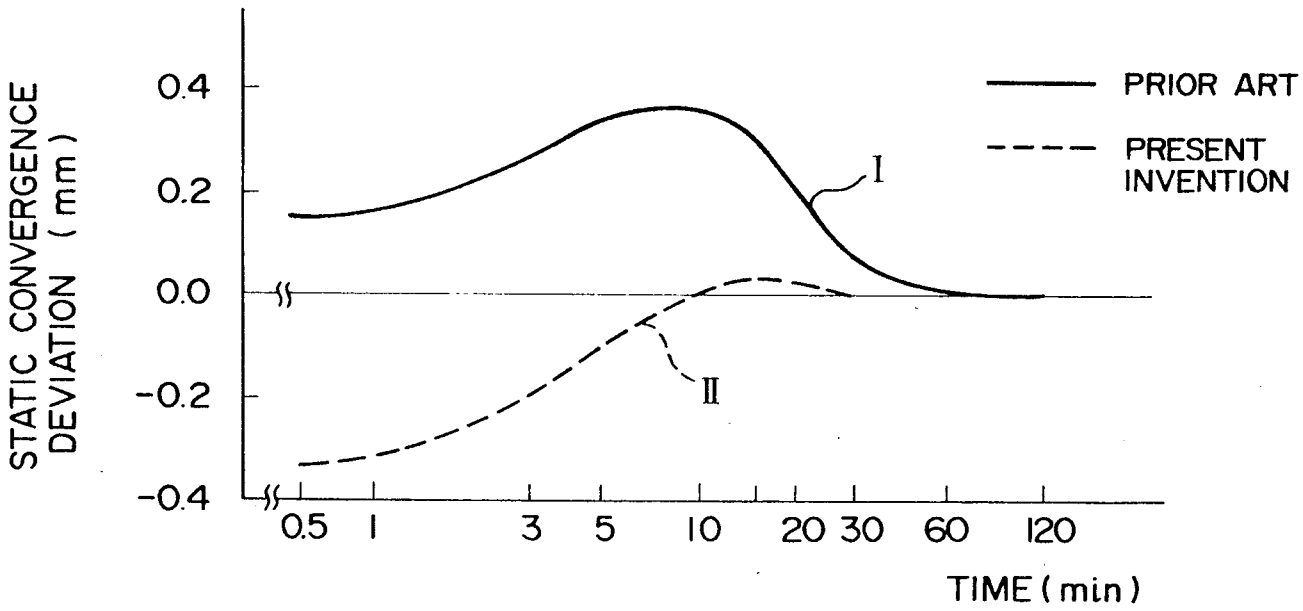
FIG. 4 is a graphical representation showing a convergence characteristic of a color CRT according to an embodiment of the invention.

FIG. 4 graphically shows measurement results of a convergence characteristic obtained with a 14-inch color CRT according to another embodiment of the invention. An electron gun of this CRT uses similar electrode structure and application voltage to those shown and explained in connection with FIG. 2 and acts as a bipotential-unipotential focusing lens type electrode structure electron gun. In this embodiment, electrode units 3 and 5 are made of an alloy containing about 42 wt % of Ni, about 19 wt % of Cr and the balance of Fe. For the remaining electrode units, stainless steel is used.

Static convergence deviation with time was measured on the phosphor screen of a color CRT with an electron gun having electrode units all made of stainless steel (14 wt % of Ni, 16 wt % of Cr and the balance of Fe) and of a color CRT with an electron gun manufactured according to teachings of the present embodiment. In FIG. 4, curve I is for the former color CRT and curve II is for the latter CRT.

As demonstrated in FIG. 4, the static convergence deviation changes with time after start of operation of the color CRT but the deviation reaches a stable point earlier and has a smaller peak to peak value with the latter CRT of this embodiment as indicated at dotted curve than with the former, conventional CRT as indicated at solid curve.

As is clear from the above, the spatial displacement of electrodes due to heat can be minimized, the static convergence deviation with time for the color CRT can be reduced as compared with that in the prior art CRT. Further, the material cost can be reduced to 50% or less of the conventional material cost. Namely, since Ni is generally so expensive that cost of a Ni-Cr-Fe alloy is predominantly determined by the Ni content therein. In the above-described embodiment, the Ni content is almost half or less of that in the conventional nichrome alloy (80 wt % Ni).

A characteristic similar to that represented by curve II in FIG. 4 could be obtained with a color CRT having an electron gun manufactured using a Ni-Cr-Fe alloy containing a Ni content ranging from 38 wt % to 50 wt %, a Cr content ranging from 16 wt % to 20 wt % and the balance of Fe.

Figure 5A:
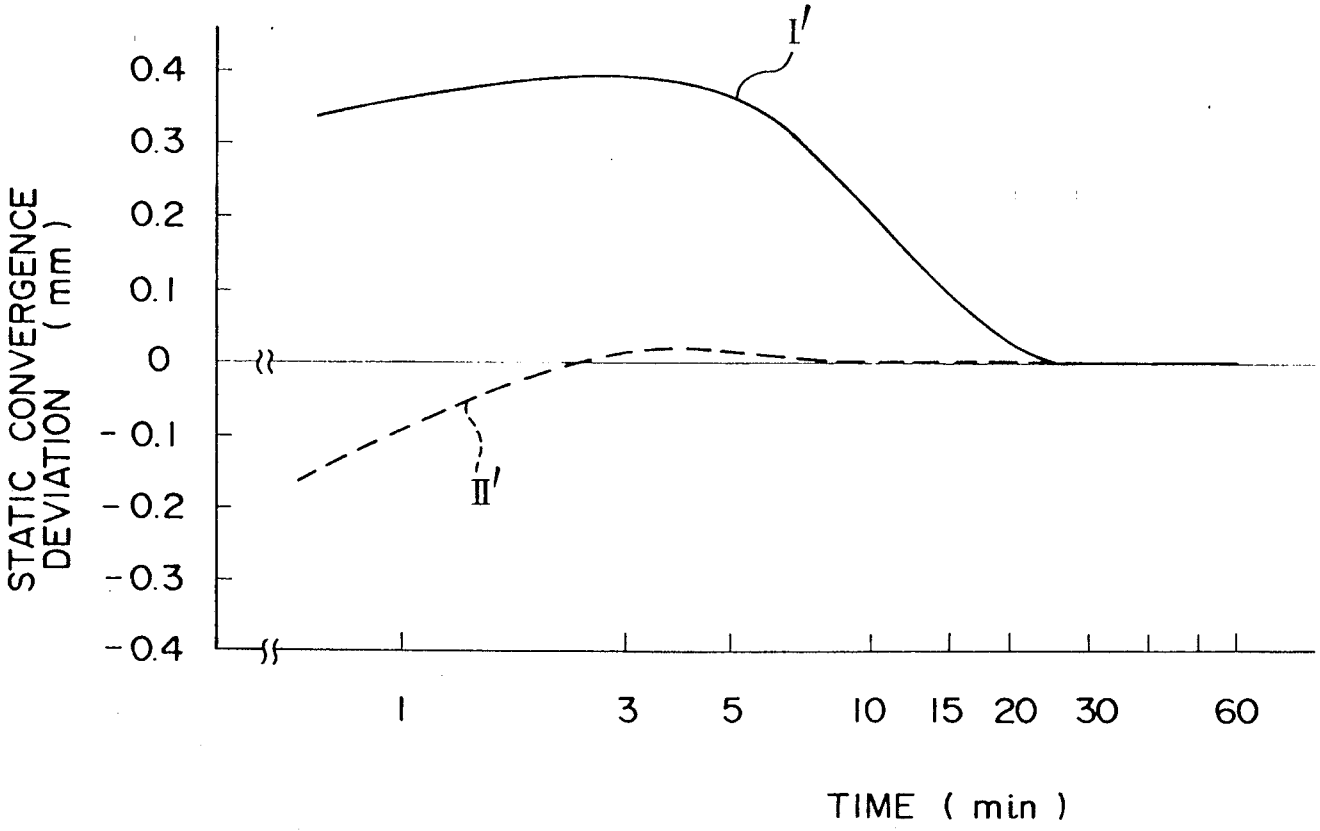
FIG. 5 is a graphical representation similar to FIG. 4 and showing a convergence characteristic of a color CRT according to another embodiment of the invention.
FIG. 5B is a sectional view schematically illustrating an example of an electron gun of the CRT referred to in connection with FIG. 5A.
Figure 5B:
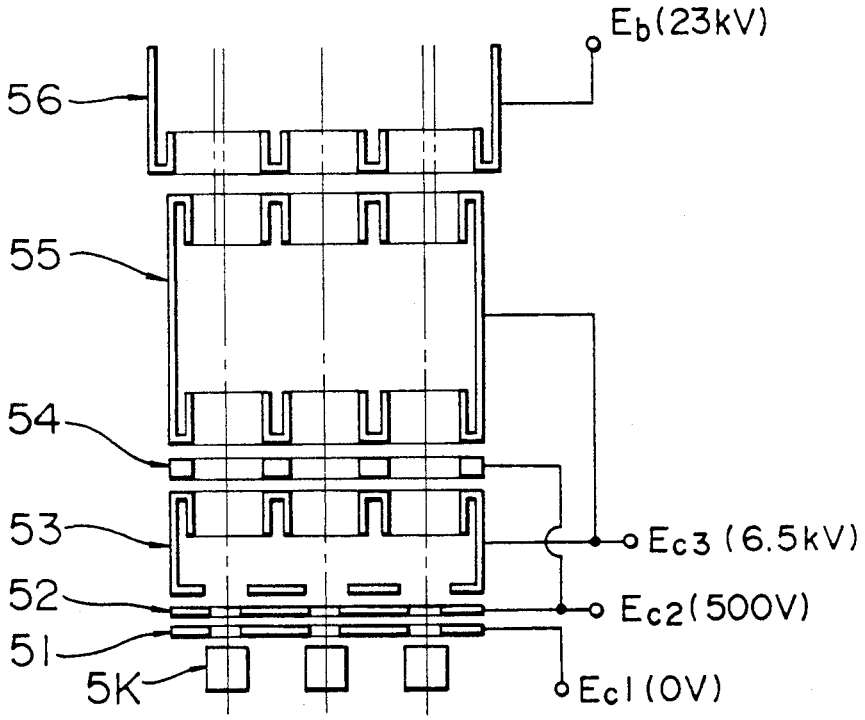

FIG. 5B is a diagram schematically showing an electron gun of a color CRT according to another embodiment of the present invention. This electron gun has a unipotential-bipotential focusing lens electrode structure. Although it has electrodes similar to those show in FIG. 2, the conditions for values of voltages to be applied to respective electrode units are different, since the electron lenses to be formed by the electrode units are different.

When the electron gun is for a 20-inch color CRT, for example, an accelerating voltage of about 27 kV is applied to the electrode unit 56, a focusing voltage of about 6 kV is applied to the electrode units 55 and 53, a voltage of about 500 V is applied to the electrode unit 52, and a voltage of about 0 V is applied to the electrode unit 51, for operation of the electron gun.

FIG. 5A graphically shows measurement results of a convergence characteristic obtained with the 20-inch color CRT referred to in connection with FIG. 5B. In this embodiment, electrode unit 54 is made of an alloy containing about 42 wt % of Ni, about 19 wt % of Cr and the balance of Fe. For the remaining electrode units, stainless steel is used.

In FIG. 5A, curve I' represents a convergence characteristic of the prior art CRT in which all of the electrode units of the electron gun are made of stainless steel, while curve II' represents a convergence characteristic of the CRT according to an embodiment of the present invention.

As can be seen, the static convergence deviation reaches a stable point earlier and has a smaller peak to peak value with the CRT according to this embodiment of the present invention as compared with those with the prior art, similar to the illustration in FIG. 2.

Although use is made of a multi-stage focusing lens structure such as a bipotential-unipotential focusing lens structure or a unipotential-bipotential focusing lens structure for the electron gun in the above-described embodiments, similar effects are obtainable with electron guns of a single stage focusing lens structure such as bipotential focusing lens structure or unipotential focusing lens structure by the use of the Ni-Cr-Fe alloy of a composition for at least one of the electrode units of the electron gun.

A Ni-Cr-Fe alloy in which the Cr content is changed with the Ni content fixed to a certain value falling between 38 wt % and 50 wt % and the balance being Fe may have a thermal expansion coefficient and a relative permeability which become larger and smaller, respectively, as the Cr content increases. On the other hand, a Ni-Cr-Fe alloy in which the Ni content is changed with the Cr content fixed and the balance being Fe may have a thermal expansion coefficient and a relative permeability which becomes smaller and larger, respectively, as the Ni content increases.

Figure 8:
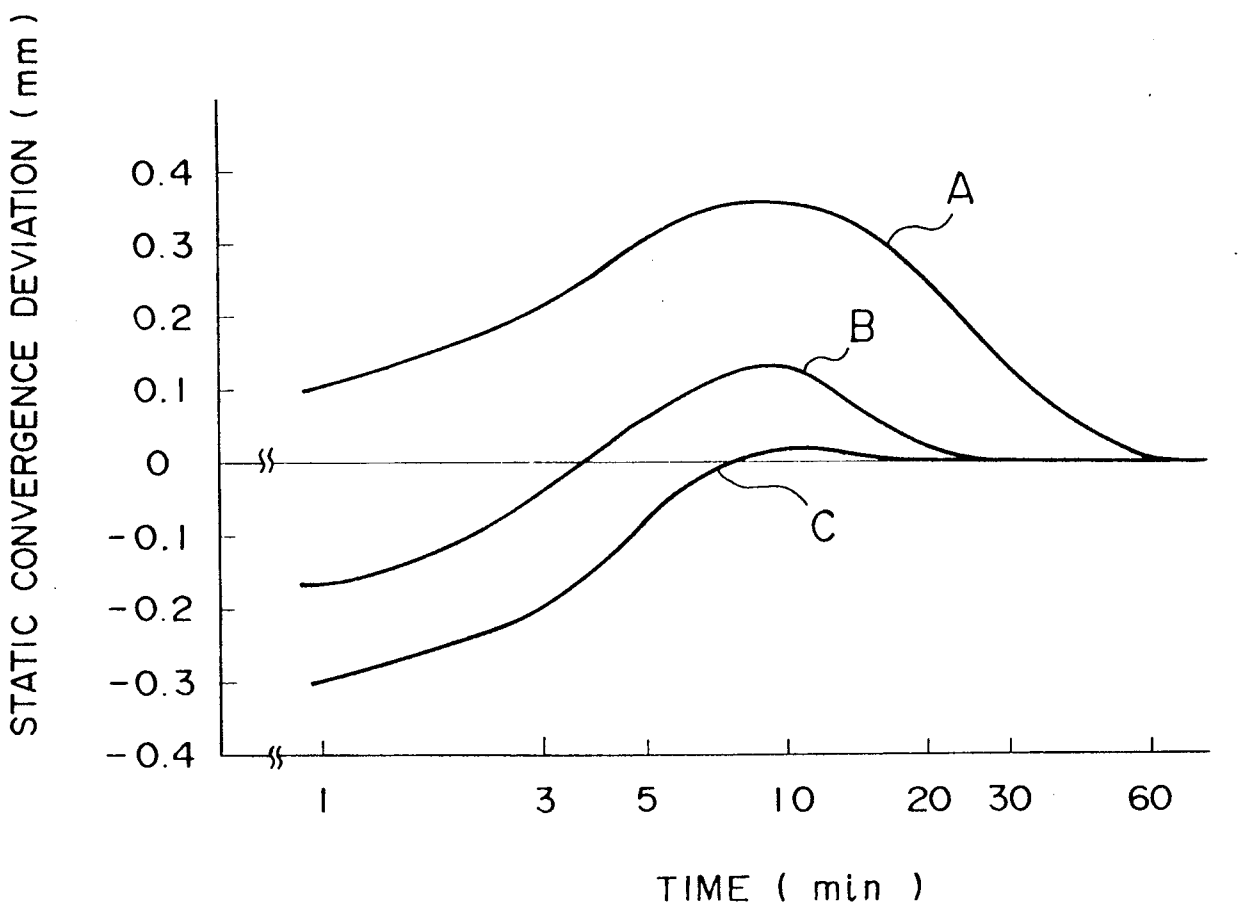
FIG. 8 is a graph showing a relation between the static convergence deviation of electron guns and the thermal expansion coefficient of the materials of electrode units of the electron guns.

FIG. 8 shows characteristic curves of a relation between the static convergence deviation and the thermal expansion coefficient of the material for the electrode unit(s) of the electron gun in a 20-inch color CRT.

The electron gun has a bipotential-unipotential focusing lens structure similar to that shown in FIG. 2. Curve A represents a characteristic of a color CRT having an electron gun in which all of the electrode units are made of stainless steel; Curve B represents a characteristic of a color CRT having an electron gun in which electrode units 3 and 5 are made of a Ni-Cr-Fe alloy having a thermal expansion coefficient $16.0\times10^{-6}$/°C., and the remaining electrode units are made of stainless steel; and Curve C represents a characteristic of a color CRT having an electron gun in which electrode units 3 and 5 are made of a Ni-Cr-Fe alloy having a thermal expansion coefficient $14.8\times10^{-6}$/°C. and the remaining electrode units are made of stainless steel.

Next, study has been made as to the influences of the Cr content in a Ni-Cr-Fe alloy on its mechanical property or on the machinability of the alloy, particularly when the alloy is used to form a cup-like electrode for an electron gun.

A cup-like electrode shaped from a plate of a Ni-Cr-Fe alloy by pressing provides a shape and dimensions almost expected, when the Cr content in the Ni-Cr-Fe alloy is not larger than 20 wt %. Thus, it has been found that Cr content not larger than 20 wt % in a Ni-Cr-Fe alloy will provide a material for the electrode unit for a mass-production with a high production yield. On the contrary, if the Cr content increases to a value more than 20 wt % in a Ni-Cr-Fe alloy, the shaped cup-like electrode is apt to be subjected to crack or the like to decrease the production yield. The Vickers hardness of the Ni-Cr-Fe alloy having a Cr content of 20 wt % was about 165. It may be said that the larger the hardness of the Ni-Cr-Fe alloy is, the lower the machinability of the alloy will be. Thus, the Cr content in a Ni-Cr-Fe alloy should be about 20 wt % or lower from the viewpoint of the machinability.

Figure 6:
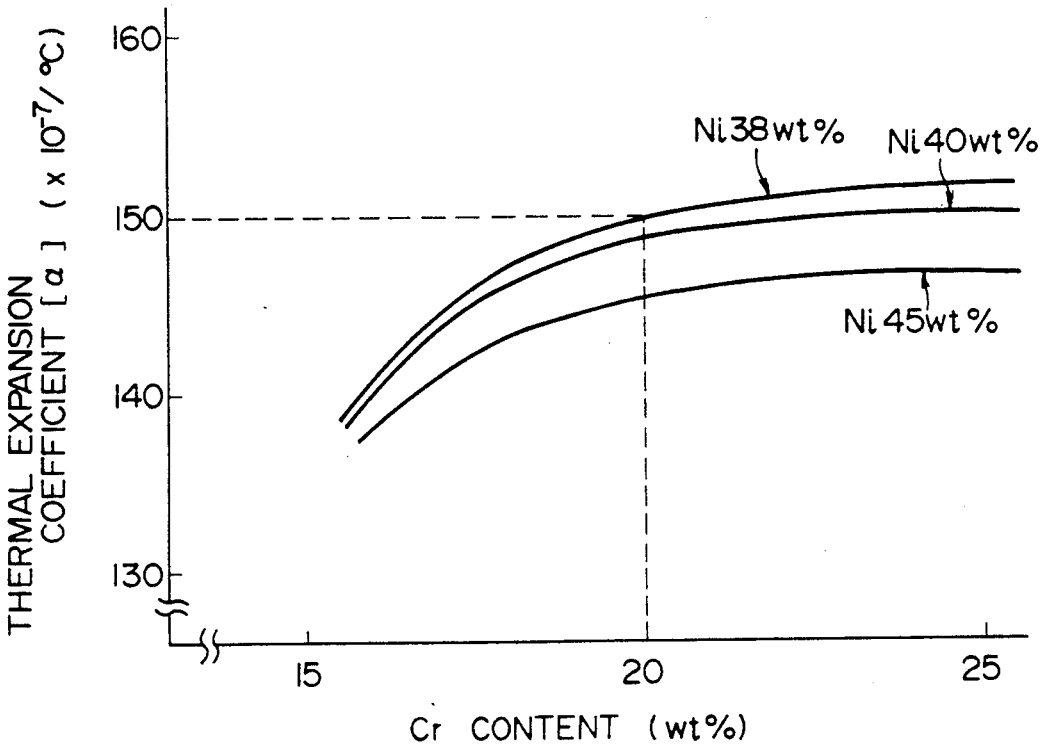
FIG. 6 is a graph showing the thermal expansion coefficient-Cr content relation in a Ni-Cr-Fe alloy by using a Ni content as parameter.
Figure 7:
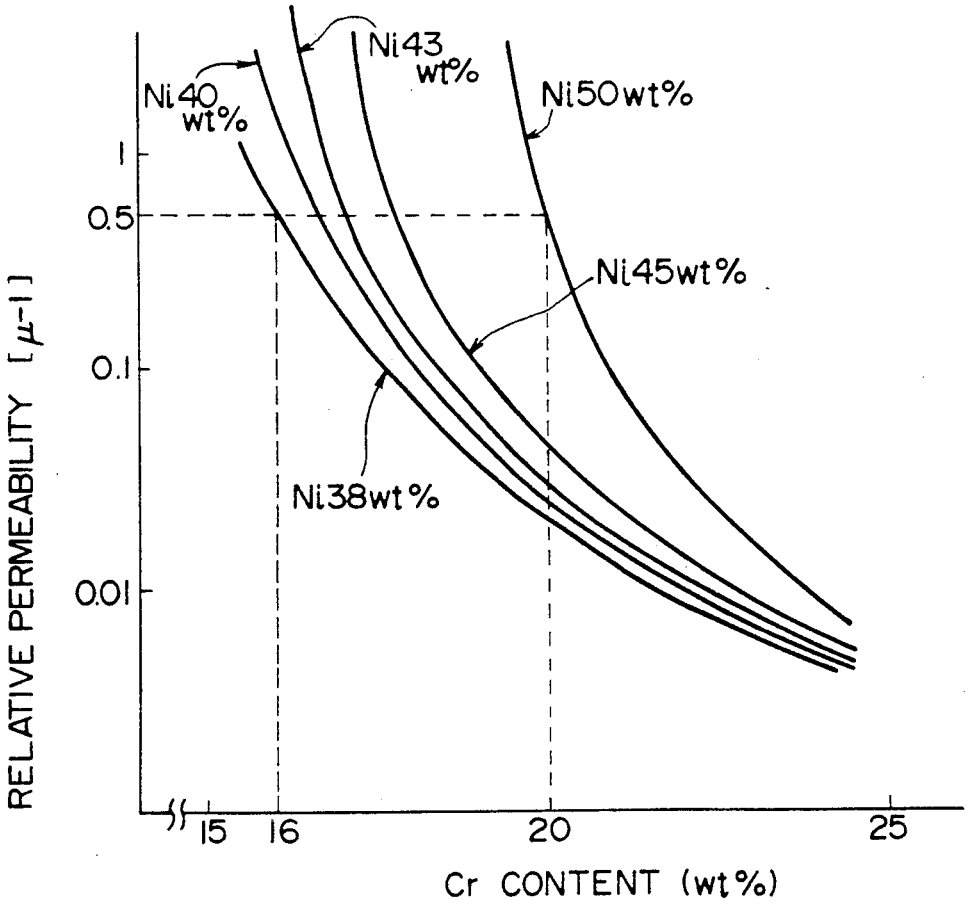
FIG. 7 is a graph showing the relative permeability-Cr content relation in the Ni-Cr-Fe alloy by using the Ni content as parameter..

FIG. 6 graphically shows the relation between the thermal expansion coefficient and the Cr content of the Ni-Cr-Fe alloy by using the Ni content as parameter, and FIG. 7 graphically shows the relation between the permeability and the Cr content by using the Ni content as parameter.

As will be seen from FIGS. 6 and 7, the alloy used for making at least one electrode unit of the electron gun may have a thermal expansion coefficient not higher than about $15\times10^{-6}$/°C. and a relative permeability not higher than about 15.

I claim:

1. An electron gun having cathodes each for producing an electron beam and a plurality of electrodes for forming electron lenses with individual voltages applied thereto, each of said electron lenses being formed by at least two electrodes successively arranged in a direction of the axis of the electron gun in which first and second voltages are applied to first and second electrodes of said at least two electrodes in operation, said first voltage being lower than said second voltage, wherein said first electrode in the successively arranged at least two electrodes for formation of at least one of said electron lenses is made of an alloy containing 38–50 wt % of Ni, 16–20 wt % of Cr and the balance of Fe.

2. An electron gun according to claim 1, wherein said first electrode is cup shaped.

3. An electron gun according to claim 1, in which said first electrode is arranged closer to said cathode than said second electrode.

4. An electron gun according to claim 1, in which said plurality of electrodes includes three electrodes successively arranged in a direction of the electron gun axis and in which an intermediate electrode of said three successively arranged electrodes serves as said first electrode.

5. An electron gun according to claim 1, in which said plurality of electrodes includes three electrodes successively arranged in a direction of the electron gun axis for forming a unipotential focusing electron lens in which an intermediate electrode of said three successively arranged electrodes serves as said first electrode.

6. An electron gun having cathodes each for producing an electron beam and a plurality of electrodes for forming electron lenses with individual voltages applied thereto, each of said electron lenses being formed by at least two electrodes successively arranged in a direction of the axis of the electron gun in which first and second voltages are applied to first and second electrodes of said at least two electrodes in operation, said first voltage being lower than said second voltage, wherein at least one of said electrodes is made of an alloy containing 38–50 wt % of Ni, 16–20 wt % of Cr and the balance of Fe such that trajectories for the electron beams deviated by distortion of said at least one electron lens due to deformation of at least one of said electrodes caused by heat generated by said cathodes in operation are corrected owing to differences in the thermal expansion coefficient between said electrodes, said alloy having a thermal expansion coefficient not higher than about $15\times10^{-6}$/°C.

7. An electron gun having cathodes each for producing an electron beam and a plurality of electrodes for forming electrical lenses with individual voltages applied thereto, each of said electron lenses being formed by at least two electrodes successively arranged in a direction of the axis of the electron gun in which first and second voltages are applied to first and second electrodes of said at least two electrodes in operation, said first voltage being lower than said second voltage, wherein said first electrode in the successively arranged at least two electrodes for formation of at least one of said electron lenses is made of a Ni-Cr-Fe alloy containing 38–50 wt % of Ni, 16–20 wt % of Cr and a balance of Fe, said alloy having a thermal expansion coefficient not higher than about $15\times10^{-6}$/°C. and a relative permeability not higher than about 1.5.

8. A color cathode-ray tube including an electron gun having cathodes each for producing an electron beam and a plurality of electrodes for forming electron lenses with individual voltages applied thereto, each of said electron lenses being formed by at least two electrodes successively arranged in a direction of the axis of the electron gun in which first and second voltages are applied to first and second electrodes of said at least two electrodes in operation, said first voltage being lower than said second voltage, wherein said first electrode in the successively arranged at least two electrodes for formation of at least one of said electron lenses is made of an alloy containing 38–50 wt % of Ni, 16–20 wt % of Cr and the balance of Fe.

9. A color cathode-ray tube including an electron gun having cathodes each for producing an electron beam and a control electrode unit, a focusing electrode unit and an accelerating unit successively arranged in a direction of the axis of the electron gun, wherein at least one of said electrode units is made of an alloy containing 38–50 wt % of Ni, 16–20 wt % of Cr and the balance of Fe and having a thermal expansion coefficient of not higher than about $15\times10^{-6}$/°C. and a relative permeability of not higher than about 1.5.

10. An electron gun comprising cathode means for emitting electrode beams, a plurality of electrodes including a first electrode and a second electrode for forming an electron lens for focusing electron beams emitted by said cathode means, said first and second electrodes being successively arranged in an axial direction of the electron gun with a first voltage and a second voltage being applied to said first electrode and said electrode, respectively, in operation of said electron gun, said first voltage being lower than said second voltage, and wherein said first electrode is made of an alloy containing 38–50 wt % of Ni, 16–20 wt % of Cr and the balance of Fe.

* * * * *